US007468577B2

(12) United States Patent
Jin et al.

(10) Patent No.: US 7,468,577 B2
(45) Date of Patent: Dec. 23, 2008

(54) ELECTRON EMISSION DISPLAY HAVING A SPACER WITH INNER ELECTRODE INSERTED THEREIN

(75) Inventors: Sung Hwan Jin, Suwon (KR); Gi Young Song, Youngwol (KR)

(73) Assignee: Samsung SDI Co., Ltd., Suwon-si (KR)

( * ) Notice: Subject to any disclaimer, the term of this patent is extended or adjusted under 35 U.S.C. 154(b) by 294 days.

(21) Appl. No.: 11/264,663

(22) Filed: Oct. 31, 2005

(65) Prior Publication Data

US 2006/0091783 A1 May 4, 2006

(30) Foreign Application Priority Data

Oct. 29, 2004 (KR) ..... 10-2004-0086962

(51) Int. Cl.
*H01J 1/88* (2006.01)
*H01J 1/62* (2006.01)
*H01J 63/04* (2006.01)

(52) U.S. Cl. ..... 313/292; 313/238; 313/239; 313/240; 313/495

(58) Field of Classification Search ..... 313/495–497, 313/238–241, 292
See application file for complete search history.

(56) References Cited

U.S. PATENT DOCUMENTS 5,656,887 A * 8/1997 Voshell et al. ..... 313/496
5,726,529 A 3/1998 Dean et al.
6,249,083 B1 * 6/2001 Kim ..... 313/495
6,420,824 B1 * 7/2002 Abe et al. ..... 313/495
6,441,559 B1 8/2002 Yamamoto et al.
6,489,718 B1 12/2002 Schmid et al.
2001/0028215 A1 * 10/2001 Kim ..... 313/495
2004/0124762 A1 * 7/2004 Fushimi ..... 313/497
2005/0062401 A1 * 3/2005 Shimizu ..... 313/495

FOREIGN PATENT DOCUMENTS

KR 2001-0075785 8/2001
KR 2001-75785 8/2001

OTHER PUBLICATIONS

Korean Patent Abstracts for Publication No. 1020010075785; Date of publication of application Aug. 11, 2001, in the name of Jae-Cheol Cha et al.

* cited by examiner

*Primary Examiner*—Karabi Guharay
*Assistant Examiner*—Bumsuk Won
(74) *Attorney, Agent, or Firm*—Christie, Parker & Hale, LLO

(57) ABSTRACT

A spacer for an electron emission display and an electron emission display containing the spacer. The spacer includes an insulating member having a predetermined shape, and at least one inner electrode laterally inserted into the insulating member. A portion of the inner electrode is exposed to an outer side of the insulating member. The electron emission display includes: an electron emission substrate having an electron emission region containing an electron emission device thereon; an image-forming substrate having an image forming region adapted to light from electrons emitted by the electron emission device; and at least one spacer for spacing apart the electron emission substrate from the image-forming substrate. At least one inner electrode is inserted into the spacer, and at least a portion of the inner spacer is exposed to the exterior of the spacer.

20 Claims, 6 Drawing Sheets

FIG. 2A(1)
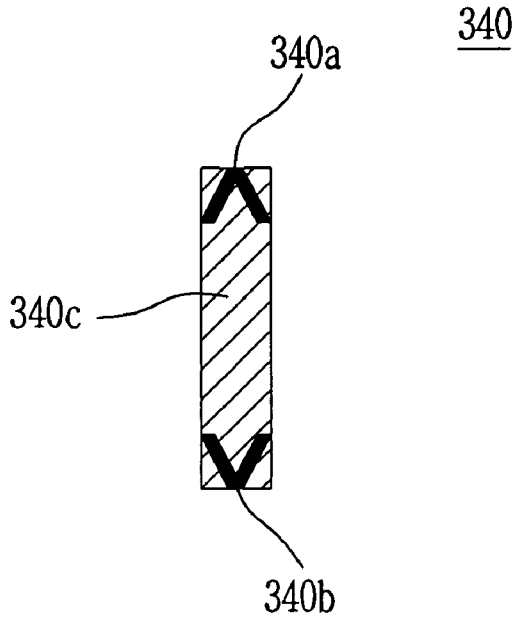
FIG. 2A(2)
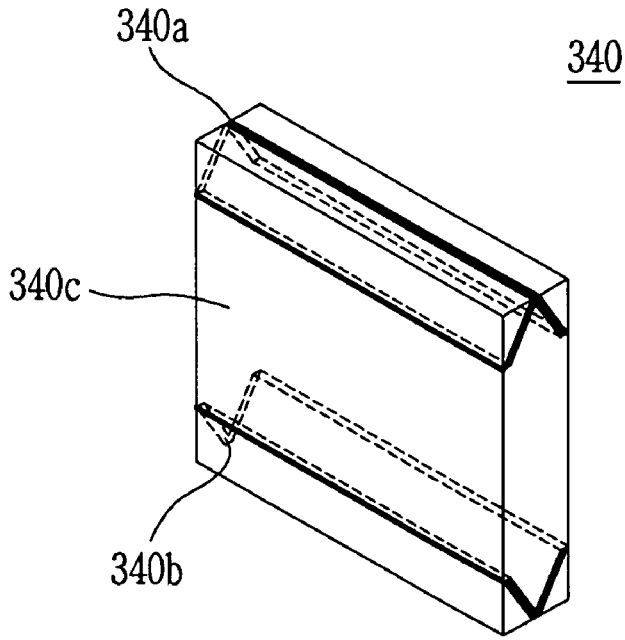

FIG. 3A(1)
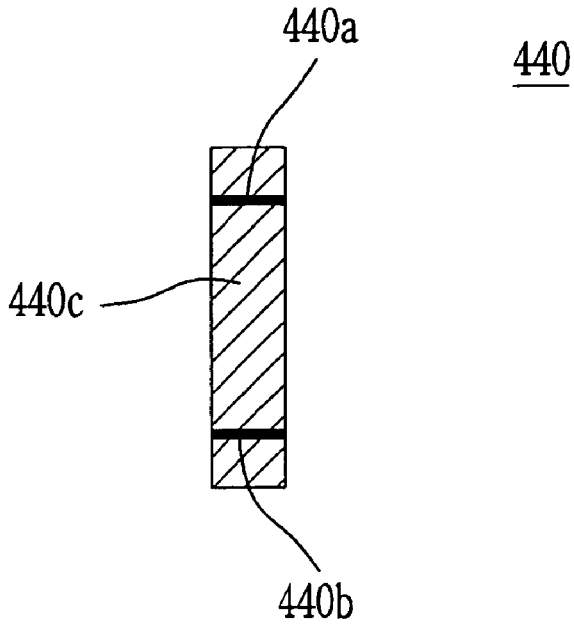
FIG. 3A(2)
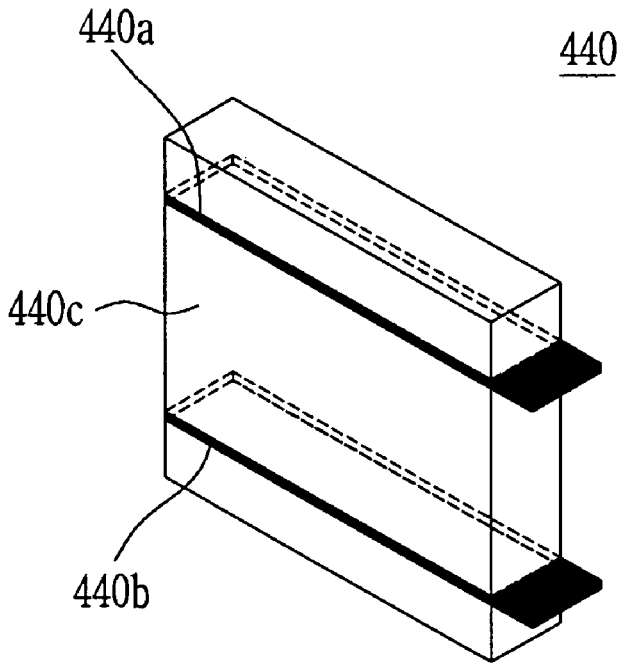

ELECTRON EMISSION DISPLAY HAVING A SPACER WITH INNER ELECTRODE INSERTED THEREIN

CROSS-REFERENCE TO RELATED APPLICATION

This application claims priority to and the benefit of Korean Patent Application No. 10-002004-86962, filed Oct. 29, 2004, the disclosure of which is hereby incorporated herein by reference in its entirety.

BACKGROUND

1. Field of the Invention

The present invention relates to an electron emission display having a spacer and, more particularly, to an electron emission display capable of controlling paths of electrons by inserting an electrode in a spacer.

2. Discussion of Related Art

In general, an electron emission device uses a hot cathode or a cold cathode as an electron source. The electron emission device using the cold cathode may employ a field emitter array (FEA) type, a surface conduction emitter (SCE) type, a metal-insulator-metal (MIM) type, a metal-insulator-semiconductor (MIS) type, a ballistic electron surface emitting (BSE) type, and so on.

Using these electron emission devices, an electron emission display, various backlights, an electron beam apparatus for lithography and so on can be implemented. Among them, the electron emission display includes a cathode substrate including at least one electron emission device to emit electrons, and an anode substrate for allowing the emitted electrons to collide with a fluorescent layer to emit light. The electron emission display includes the cathode substrate, the anode substrate, a line-shaped cathode electrode disposed at one side of the cathode substrate, and a line-shaped anode electrode disposed at one side of the anode substrate to perpendicularly intersect the cathode electrode. An electron emission part emitting electrons while forming an electric field is provided at one side of the cathode electrode. Additionally, fluorescent layers emitting light by a collision of the electrons emitted from the electron emission part are provided at a surface of the anode electrode, and a spacer is provided at one side of the anode substrate. The spacer functions to prevent the substrate from being deformed and damaged when the cathode substrate and the anode substrate are vacuum-sealed.

An example of the electron emission display adapting the aforementioned spacer is disclosed in Korean Patent Laid-open Publication No. 2001-75785. Hereinafter, a conventional electron emission display will be described in conjunction with the accompanying drawing.

FIG. 1 is a partial cross-sectional view of an electron emission display having a conventional spacer. A line-shaped cathode electrode 22 is provided at one side of the cathode substrate 21, and a surface type electron emission part 23 is provided on the cathode electrode 22. A line-shaped anode electrode 12 perpendicularly intersecting the cathode electrode 22 is provided on the anode substrate 11 opposite to the cathode substrate 21, and fluorescent layers 14 emitting light by a collision of electrons emitted from the electron emission part 23 are provided on the anode electrode 12. An auxiliary spacer 34*a* also functioning as a light-shielding layer is provided at a space between the anode electrodes 12. A plurality of spacers 34 spaced from each other by a predetermined interval are disposed at a region, at which the anode substrate 11 and the cathode substrate 21 are sealed to each other. Each of the spacers 34 is adhered to one of the anode substrate 11 and the cathode substrate 21 using frit.

Therefore, when the spacer 34 is adhered to one of the anode substrate 11 and the cathode substrate 21 using frit, the both substrates maintain a certain gap by virtue of the spacer 34.

However, some of the emitted electrons collide with the spacer and ions generated by action of the emitted electrons charge up the spacer. Paths of the electrons emitted from the electron emission device are changed by the charged spacer, and the electrons arrive at positions other than the corresponding fluorescent layer, generating distorted images around the spacer.

SUMMARY OF THE INVENTION

In accordance with the present invention, an electron emission display is provided capable of reducing charge and discharge phenomena of a surface of a spacer and controlling paths of electrons by inserting electrodes in both ends of the spacer.

In an exemplary embodiment of the present invention, a spacer for an electron emission display includes an insulating member having a predetermined shape, and at least one inner electrode laterally inserted into the insulating member, wherein a portion of the inner electrode is exposed to an outer side of the insulating member.

The inner electrode may have a resistance value of about $10^5 \sim 10^{12}$ Ω/□. The electrical power is supplied through a part of the inner electrode exposed to exterior the insulating member.

In another exemplary embodiment of the present invention, an electron emission display includes: an electron emission substrate having an electron emission region having an electron emission part thereon; an image-forming substrate having an image forming region emitting light by electrons emitted from the electron emission device; and at least one spacer for spacing apart the electron emission substrate from the image-forming substrate to be spaced apart from each other, wherein at least one inner electrode is inserted into the spacer, and at least a portion of the inner spacer is exposed to the exterior of the spacer.

The inner electrode may be formed in a lateral direction to the spacer. Power may be applied through the inner electrode exposed to the exterior of the spacer. The inner electrode may be formed at an upper or lower end in the spacer, respectively. The spacer may include glass or ceramic material. The inner electrode may include a material having an excellent conductivity in comparison with the spacer. The inner electrode may have a resistance value of about $10^5 \sim 10^{12}$ Ω/□. Power may be applied to the inner electrode through upper and lower surfaces of the spacer. A power source may be applied to the inner electrode through side surfaces of the spacer. The electron emission device may include a first electrode, a second electrode insulated from and intersected with the first electrode, and an electron emission part electrically connected to the first electrode.

According to a further aspect of the invention, the upper and lower ends of the spacer are applied with voltages having different levels from each other.

BRIEF DESCRIPTION OF THE DRAWINGS

FIGS. 2A(1) and 2A(2) are a cross-sectional view and a perspective view, respectively, schematically illustrating a spacer structure according to an embodiment of the present invention.

FIGS. 3A(1) and 3A(2) are a cross-sectional view and a perspective view, respectively, schematically illustrating a spacer structure according to another embodiment of the present invention.

DETAILED DESCRIPTION

The present invention will first be described with reference to FIGS. 2A to 4, in which exemplary embodiments of the invention are shown.

Referring now to FIGS. 2A(1), 2A(2) and 2B, the spacer 340 for an electron emission display includes an insulating member 340*c* having a predetermined shape, and at least one inner electrode 340*a* or 340*b* laterally inserted into the insulating member 340*c*, wherein some portions of the inner electrode 340*a* or 340*b* are exposed to an outer side surface of the insulating member 340*c*.

The spacer 340 may have insulation characteristics sufficient to endure a high voltage applied between an electron emission substrate 100 and an image-forming substrate 200 and conductivity sufficient to prevent electrification and charge of a surface of the spacer.

The insulating member 340*c* for providing sufficient insulation performance to the spacer 340 includes, for example, quartz glass, glass having a Na component, sodalime glass, alumina, or a ceramic material composed of alumina. In an exemplary embodiment, a thermal expansion coefficient of the insulating member 340*c* would be similar to that of the electron emission substrate and the image-forming substrate.

The spacer 340 prevents its surface from being charged, and includes a first inner electrode 340*a* and a second inner electrode 340*b* controlling distortion of paths of electrons due to the charge of the spacer itself or its surface in upper and lower ends of the spacer 340, respectively.

Electrical charges generated on the surface of the spacer 340 are rapidly removed through the first and second electrodes 340*a*, 340*b* exposed through the upper and lower surfaces of the spacer 340 to the exterior. As a result, it is possible to reduce distortion and irregularity of images.

In an exemplary embodiment, the first and second inner electrodes 340*a* and 340*b* may have reference values of about $10^5$~$10^{12}$ Ω/□ in order to have sufficient conductivity, and may be made of materials selected from metal such as Ni, Cr, Au, Mo, W, Pt, Ti, Al, Cu and Pd, and alloys thereof; metal or metal oxide such as Pd, Ag, Au, $RuO_2$ and Pd—Ag; a transparent conductive material such as $In_2O_3$—$SnO_2$; and a semiconductor material such as polysilicon. In an exemplary embodiment, the conductivity of the first and second inner electrodes 340*a* and 340*b* may be set not more than $10^{12}$ Ω/□ in consideration of charge prevention and power consumption, and is set not less than $10^5$ Ω/□ depending on shapes of the spacers and voltages applied between the spacers.

Figure 1:
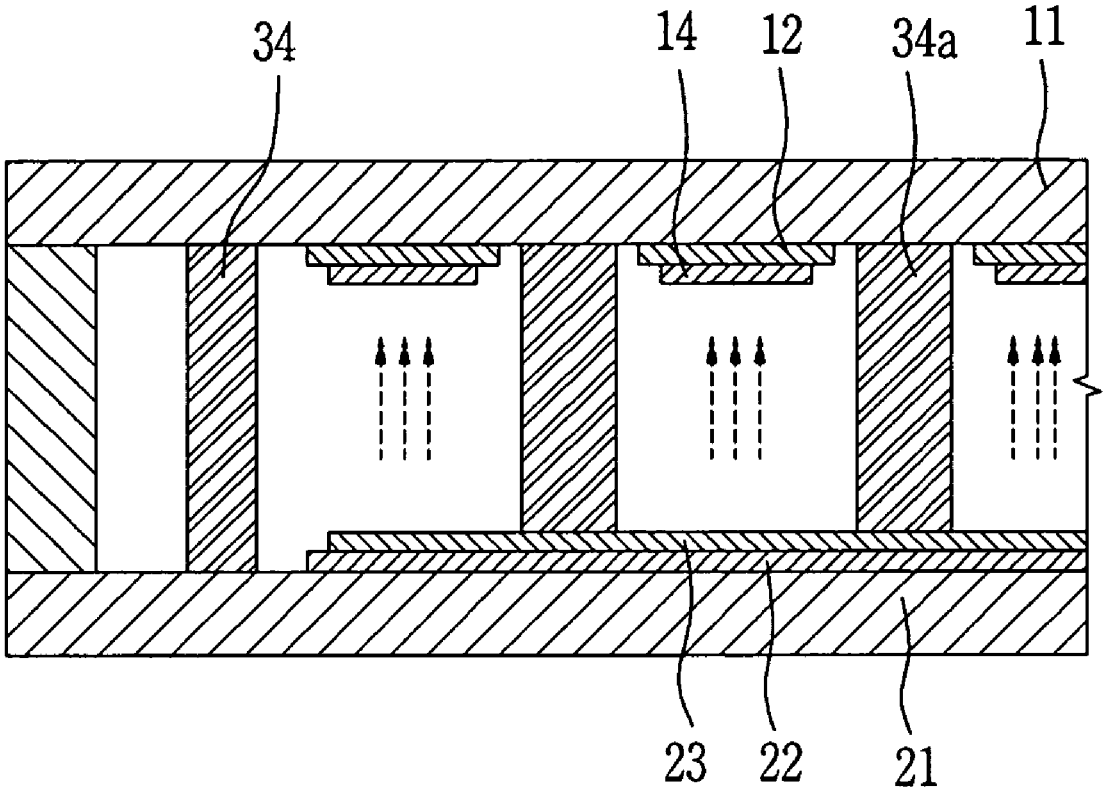
FIG. 1 (PRIOR ART)
FIG. 1 is a cross-sectional view of a portion of an electron emission display having a spacer according to the prior art.
Figure 2B:
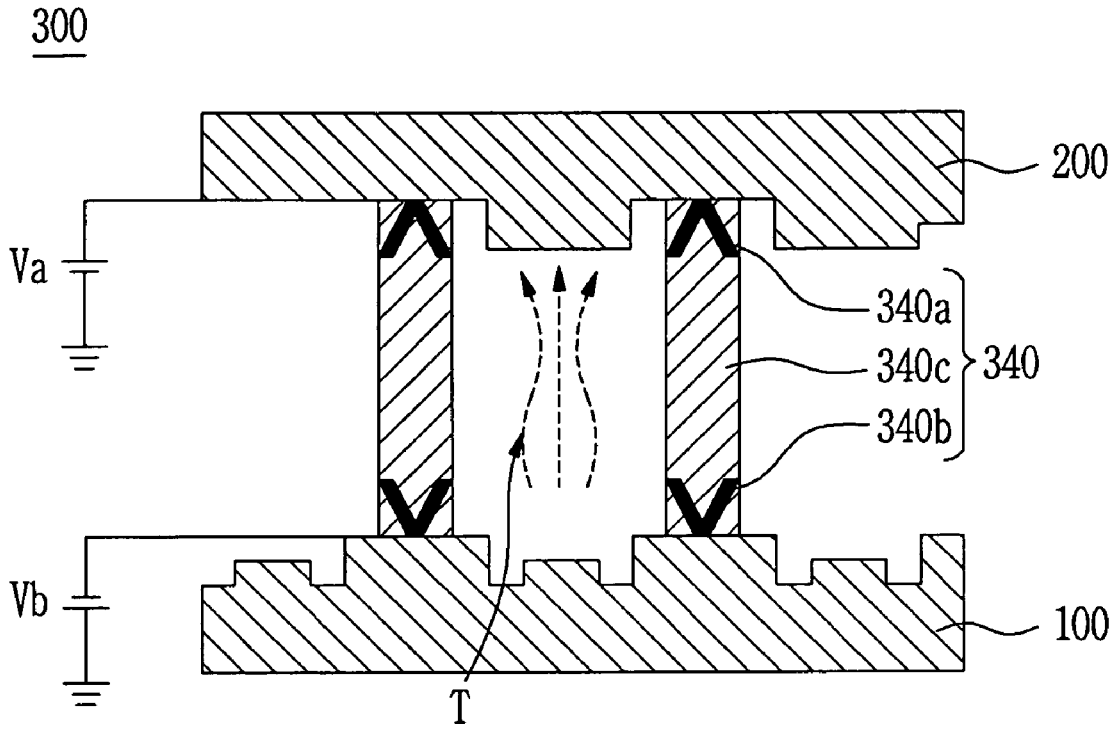
FIG. 2B is a schematic cross-sectional view of an electron emission display adapting a spacer structure according to the embodiment of FIGS. 2A(1) and 2A(2).

As can be seen in FIG. 2B, electrical power may be applied through some portion of the first and second inner electrodes 340*a*, 340*b* exposed to an outer surface of the insulating member 340*c*. In other words, in an exemplary embodiment, a positive voltage Va is applied to the first inner electrode 340*a*, and a negative voltage Vb is applied to the second inner electrode 340*b*. In this case, the electrons emitted from the electron emission substrate 100 are emitted along the electron paths T as shown in FIG. 2B. The electrons receive a repulsive force from the second inner electrode 340*b*, to which the negative voltage Vb is applied, to go away from the spacer 340, and the electrons receive an attractive force by the first inner electrode 340*a*, to which the positive voltage Va is applied, to be deflected closer to the spacer. Therefore, the electrons are directed to an image forming region formed on the image-forming substrate 200 through the discharge path formed as described above.

It is possible to suppress the electrification and charge of the surface of the spacer 340 by the electrons emitted from the electron emission substrate 100, and to reduce emission of different colors due to path distortion of the electrons and the resultant image distortion and fluctuation by preventing the electron paths from being concentrated around the spacer 340.

Figure 3B:
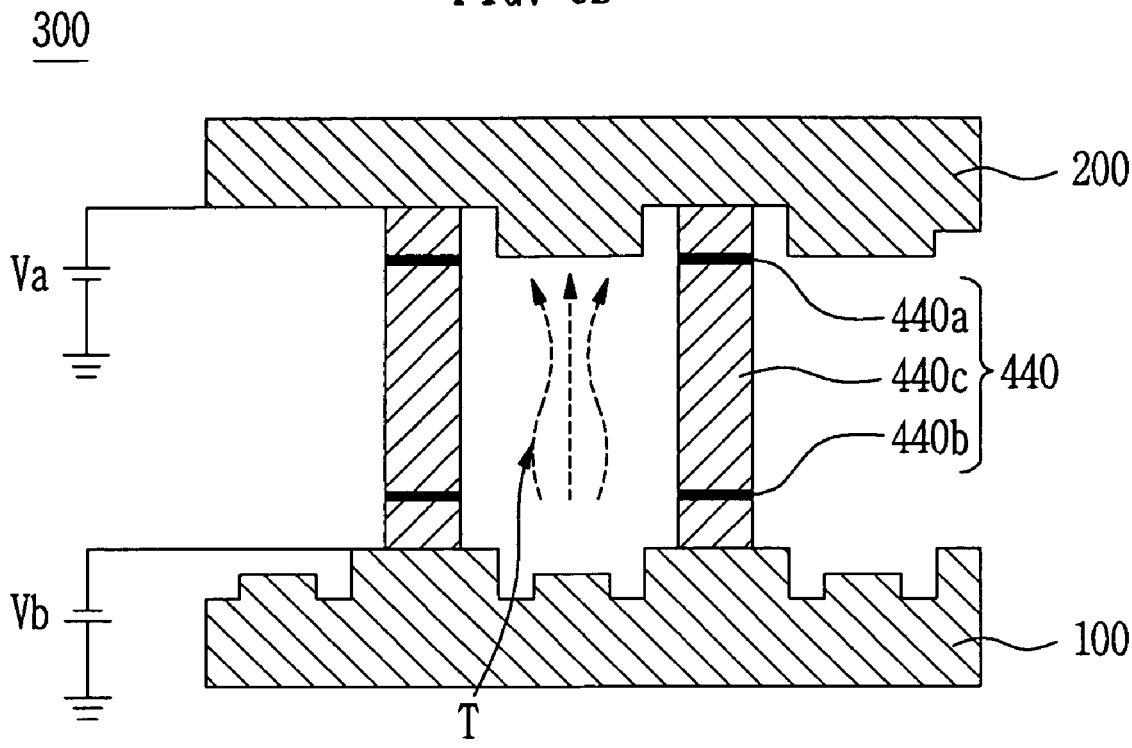
FIG. 3B is a schematic cross-sectional view of an electron emission display adapting a spacer structure according to the embodiment of FIGS. 3A(1) and 3A(2).

FIG. 3A(1) is a cross-sectional view and FIG. 3A(2) is a perspective view schematically illustrating a spacer structure according to another embodiment of the present invention, and FIG. 3B is a schematic cross-sectional view of an electron emission display adapting a spacer structure according to the embodiment of FIGS. 3A(1) and 3A(2).

Referring to FIGS. 3A(1), 3A(2) and 3B, first and second inner electrodes 440*a* and 440*b* are also exposed through side surfaces of a spacer 440, configuration and function of the spacer 440 are similar to those of the spacer 440 shown in FIGS. 2A and 2B, therefore their descriptions will be omitted.

Figure 4:
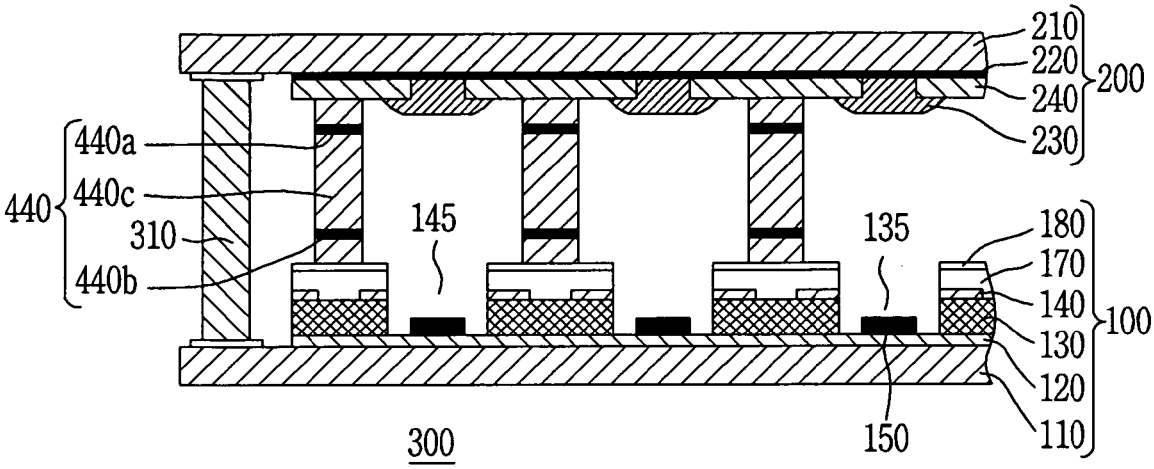
FIG. 4 is a cross-sectional view of a specific configuration of an electron emission display adapting the spacer structure shown in FIG. 2A.

FIG. 4 is a cross-sectional view of a specific configuration of an electron emission display adapting the spacer structure shown in FIGS. 3A(1) and 3A(2). Here, while the structure that the inner electrode is exposed through the side surface of the spacer is illustrated, but not limited thereto, various structures of inner electrodes may be adapted to the present invention. In addition, the spacer adapted to the electron emission substrate and the image-forming substrate will be described through a specific structure thereof.

Referring to FIG. 4, an electron emission display 300 includes an electron emission substrate 100 having an electron emission region having an electron emission part 150 formed thereon; an image-forming substrate 200 having an image forming region emitting light by electrons emitted from the electron emission part 150; and at least one spacer 440 supporting the electron emission substrate 100 and the image-forming substrate 200 to be spaced apart from each other, wherein at least one inner electrode 440*a* or 440*b* is inserted into the spacer 440, and at least a portion of the inner spacer 440*a* or 440*b* is exposed to the exterior of the spacer 440.

The embodiment of FIG. 4 illustrates an electron emission substrate having an upper gate structure, but is not limited thereto. Various structures including a lower gate structure, a dual gate structure, and all structures emitting electrons can be adapted to the present invention.

At least one cathode electrode 120 is disposed on a bottom substrate 110 in a predetermined shape, for example, stripe shape. The bottom substrate 110 is generally made of a glass or silicon substrate, and in an exemplary embodiment, made of a transparent substrate such as a glass substrate when it is formed through an exposure process from a rear surface using carbon nanotube (CNT) paste as an electron emission part 150.

The cathode electrodes 120 supply each of data signals or scan signals applied from a data driving part (not shown) or a scan driving part (not shown) to each electron emission device. The electron emission part 150 is formed at a region that the cathode electrode 120 and the gate electrode 140 intersect each other. The cathode electrode 120 is made of, for example, indium tin oxide, for the same reason the substrate 110 is made of this material.

A first insulting layer 130 is formed on the substrate 110 and the cathode electrode 120, and electrically insulates the cathode electrode 120 from the gate electrode 140. The first insulating layer 130 includes at least one first hole 135 at intersection regions of the cathode electrodes 120 and the gate electrodes 140 to expose the cathode electrode 120.

The gate electrodes 140 are disposed on the first insulating layer 130 in predetermined shapes, for example, stripe shapes, in a direction intersecting the cathode electrodes 120, and supply each of data signals or scan signals supplied from the data driving part or the scan driving part to each electron emission device. The gate electrode 140 includes at least one second hole 145 corresponding to the first hole to expose the electron emission part 150.

The electron emission part 150 is located on the cathode electrode 120 exposed by the first hole 135 of the insulating layer 130 to be electrically connected to the cathode electrode 120, and in an exemplary embodiment, may be made of carbon nanotube, graphite, graphite nanofiber, diamond carbon, $C_{60}$, silicon nanowire, and their composite materials.

A grid electrode 180 collects the electrons emitted from the electron emission part 150 to a fluorescent layer 230 corresponding to the electron emission part 150, as shown in FIG. 4, may be formed on a second insulating layer 170, or may be formed of a mesh-shaped conductive sheet without the second insulating layer 170.

As described above, the electron emission region includes a plurality of electron emission devices disposed on regions, at which cathode electrode interconnections and gate electrode interconnections intersect each other, in predetermined shapes, for example, matrix shapes, and the electron emission device includes the cathode electrode 120, the gate electrode 140 intersecting the cathode electrode 120, the first insulating layer 130 for insulating the two electrodes 120, 140, and the electron emission part 150 electrically connected to the cathode electrode 120. The electron emission parts 150 correspond to the fluorescent layers 230 formed at the image-forming substrate 200, respectively.

The image-forming substrate 200 includes a top substrate 210, an anode electrode 220 formed on the top substrate 210, and an image forming region including the fluorescent layers 230 emitting light by the electrons emitted from the electron emission part 150, and light-shielding layers 240 formed between the fluorescent layers 230.

The fluorescent layers 230 emit light by a collision of the electrons emitted from the electron emission part 150 are spaced from each other by an arbitrary interval on the top substrate 210. The top substrate 210 in an exemplary embodiment is made of a transparent material so that the light emitted from the fluorescent layer 230 is transmitted to the exterior.

An anode electrode 220 disposed on the top substrate 210 functions to more favorably collect the electrons emitted from the electron emission device 160, and is made of a transparent material. In one exemplary embodiment the anode electrode 220 is made of an indium tin oxide (ITO) electrode.

The light-shielding layers 240 are disposed spaced from each other by an arbitrary interval between the fluorescent layers 230 in order to suppress movement of colors in spite of the deviation of irradiation positions of the electron beams to prevent decrease of contrast and charge of the fluorescent layer by the electrons on display by blocking reflection of external light.

While it is illustrated that a first side of the spacer 440 is formed on the light-shielding layer 240 and a second side is formed on the grid electrode 180, the second side may be formed on the first insulating layer 130.

The electron emission display 300 as described above further includes a sealant 310 for sealing the electron emission substrate 100 and the image-forming substrate 200 to maintain a space between the two substrates 100 and 200 in a vacuum state. A positive voltage is applied to the cathode electrode 120, a negative voltage is applied to the gate electrode 140, and a positive voltage is applied to the anode electrode 220, from an external power source. As a result, an electric field is formed around the electron emission part 150 by a voltage difference between the cathode electrode 120 and the gate electrode 140 to emit electrons, and the emitted electrons are induced by a high voltage applied to the anode electrode 220 to collide with the fluorescent layer 230 of the corresponding pixel to emit light from the fluorescent layer 230, thereby displaying a predetermined image.

As can be seen from the foregoing embodiments of the electron emission display of the present invention are capable of preventing electrification and charge of the surface of the spacer and suppressing concentrated distribution of the electron paths around the spacer by inserting the inner electrodes into both ends of the spacer or additionally applying a voltage to the inner electrodes.

The electron emission display having the spacer in accordance with an embodiment of the present invention has effects capable of reducing charge and discharge phenomena of the surface of the spacer and suppressing distortion of electron beams by inserting and disposing electrodes into the spacer.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. A spacer for an electron emission display, the electron emission display comprising an electron emission substrate including an electron emission region having an electron emission device thereon and an image-forming substrate having an image forming region adapted to emit light from electrons emitted by the electron emission device, the spacer comprising:

an insulating member having a top surface configured to contact the image-forming substrate and a bottom surface configured to contact the electron emission substrate; and at least one inner electrode within the insulating member, wherein at least a portion of the at least one inner electrode is exposed to an exterior of the insulating member through one of the top surface and bottom surface.

2. The spacer according to claim 1, wherein the inner electrode has a resistance value of about $10^5$ through $10^{12}\Omega/\square$.

3. The spacer according to claim 1, wherein the portion of the at least one inner electrode exposed to the exterior of the insulating member is adapted to receive externally applied power.

4. The spacer according to claim 1, wherein the at least one inner electrode extends laterally within the insulating member.

5. An electron emission display comprising:

an electron emission substrate including an electron emission region having an electron emission device thereon;

an image-forming substrate having an image forming region adapted to emit light from electrons emitted by the electron emission device; and at least one spacer for spacing the electron emission substrate from the image-forming substrate, the at least one spacer having a top surface and a bottom surface, wherein at least one inner electrode is within the spacer, such that at least a portion of the at least one inner electrode is exposed to an exterior of the spacer through one of the top surface and the bottom surface.

6. The electron emission display according to claim 5, wherein the at least one inner electrode extends laterally within the spacer.

7. The electron emission display according to claim 5, wherein the at least one inner electrode is adapted to receive externally applied power.

8. The electron emission display according to claim 5, the at least one inner electrode comprising two inner electrodes, wherein one of the two inner electrodes is exposed through the top surface and an other of the two inner electrodes is exposed through the bottom surface.

9. The electron emission display according to claim 8, wherein different voltages are applied to the upper and lower ends of the spacer.

10. The electron emission display according to claim 5, wherein the at least one inner electrode is exposed through one of the top surface or a bottom end of the spacer.

11. The electron emission display according to claim 5, wherein the spacer comprises glass or ceramic material.

12. The electron emission display according to claim 11, wherein the spacer includes a metal and wherein the at least one inner electrode includes a material having a conductivity higher than a conductivity of the metal of the spacer.

13. The electron emission display according to claim 12, wherein the at least one inner electrode has a resistance of about $10^5$~$10^{12}\Omega/\square$.

14. The electron emission display according to claim 5, wherein the at least one inner electrode is adapted to receive externally applied power.

15. The electron emission display according to claim 5, further comprising a power source applied to the at least one inner electrode through side surfaces of the spacer.

16. The electron emission display according to claim 5, wherein the electron emission device comprises:

a first electrode;

a second electrode insulated from and intersected with the first electrode; and an electron emission part electrically connected to the first electrode.

17. A method for controlling paths of electrons emitted from an electron emission display, the electron emission display including an electron emission substrate including an electron emission region having an electron emission device thereon, an image-forming substrate having an image forming region adapted to emit light from electrons emitted by the electron emission device, and at least one spacer for spacing the electron emission substrate from the image-forming substrate, the at least one spacer having a top surface and a bottom surface, the method comprising:

inserting at least one inner electrode into the spacer; and exposing at least a portion of the at least one inner electrode to an exterior of the spacer through one of the top surface and the bottom surface.

18. The method of claim 17, wherein the at least one inner electrode is lateral to the insulating member.

19. The method of claim 17, wherein the at least one inner electrode is at an upper end or lower end of the spacer.

20. The method of claim 17, wherein the at least one inner electrode has a V shape and is configured such that an apex of the V shape is exposed to the exterior.

* * * * *